US005172096A

United States Patent [19]

Tice et al.

[11] Patent Number: 5,172,096

[45] Date of Patent: Dec. 15, 1992

[54] THRESHOLD DETERMINATION APPARATUS AND METHOD

[75] Inventors: Lee D. Tice, Bartlett; Robert J. Clow, North Aurora, both of Ill.

[73] Assignee: Pittway Corporation, Chicago, Ill.

[21] Appl. No.: 741,553

[22] Filed: Aug. 7, 1991

[51] Int. Cl.[5] ..... G08B 23/00

[52] U.S. Cl. ..... 340/501; 340/511; 340/514; 340/588

[58] Field of Search ..... 340/501, 511, 510, 514, 340/505, 517, 518, 588, 589, 870.16, 870.17, 870.21

[56] References Cited

U.S. PATENT DOCUMENTS 4,394,655 7/1983 Wynne et al. .
4,459,583 7/1984 van der Walt et al. ..... 340/511
4,470,047 9/1984 Vogt et al. .
4,514,720 4/1985 Oberstein et al. ..... 340/511
4,543,567 9/1985 Shirata et al. ..... 340/511
4,546,344 10/1985 Guscott et al. ..... 340/511
4,745,399 5/1988 Kimura ..... 340/511
4,916,432 4/1990 Tice et al. .
4,930,095 5/1990 Yuchi et al. .

*Primary Examiner*—Donnie L. Crosland
*Attorney, Agent, or Firm*—Dressler, Goldsmith, Shore, Sutker & Milnamow, Ltd.

[57] ABSTRACT

A system and method for establishing an alarm threshold for each member of a plurality of detectors or sensors includes storing a value returned from each detector indicative of a clear air condition. A second value returned from each detector indicative of a test condition is stored. The stored values are combined with a common detector characteristic value to produce a unique alarm theshold for each detector. The determined alarm thresholds can be stored for subsequent use. Subsequently, a value returned from a detector indicating a current ambient condition can be compared to that detector's previously determined alarm threshold. If the currently returned value from the detector exceeds the predetermined alarm threshold, an alarm condition can be indicated.

27 Claims, 4 Drawing Sheets $$\frac{100-L}{\delta V} = 17\ pa/\mu$$

THRESHOLD DETERMINATION APPARATUS AND METHOD

FIELD OF THE INVENTION

The invention pertains to smoke and fire detection systems which utilize a plurality of spaced-apart sensors or detector elements. More particularly, the invention pertains to such systems which include a central control panel whereat a determination is made, for each sensor, as to whether or not an alarm condition exists.

BACKGROUND OF THE INVENTION

Smoke or fire detection systems which utilize a plurality of detectors or sensors spaced-apart in a region or area are known. One such system is disclosed in Tice et al. U.S. Pat. No. 4,916,432 entitled "Smoke And Fire Detection System Communication" which is assigned to the assignee of the present invention and which is incorporated herein by reference.

Known systems often provide a fixed alarm threshold at a control unit which is displaced from the sensors or detectors. The control unit communicates with the detectors or sensors via a bidirectional communication line of the type disclosed, for example, in the Tice et al. patent. Circuitry at the control unit senses a value or values returned from a selected detector or sensor which are indicative of a current ambient condition.

The sensed value or values is/are compared to a prestored threshold value which may be the same for all units. If the value or values returned from the selected detector or sensor exceed the prestored threshold value, the control unit makes a determination as to whether or not the system should go into an alarm condition.

An alarm condition can be indicated by an audible alarm. Alternately, an alarm condition can be indicated by a visual alarm.

Its recognized that the detector or sensor units vary in their behavior over a period of time after installation. Variations occur because of changing characteristics of electronic elements as they age, due to thermal stress for example. Variations also occur because different detectors are exposed to different ambient conditions.

Some detectors, for example, may be exposed to a very dusty environment. Other detectors, may be located in an area where there is a continual ambient smoke level due to normal conditions and not due to a dangerous smoke or fire condition. Additionally, some detectors or sensors may be located in an area with a higher continuous ambient temperature than other detectors thereby resulting in other variations.

These variations affect the value sent back by a given detector or sensor to the control panel. Hence, two detectors which are subjected to different environmental conditions, and which may age differently from one another, may send back to the control panel two different values indicative of the same non-smoke or clear air condition. Further, such detectors when placed into a test mode, may send back very different test values.

Thus, the known prior art practice of using a common predetermined threshold for all detectors has some serious drawbacks. It would be desirable to be able to determine a threshold for each detector, unique to that detector, which is based on the physical characteristics thereof as the detector ages. Further, it would be desirable to determine such a threshold remotely from the control panel without needing to make measurements at the detector or the sensor.

Finally, it would be desirable to be able to determine each detector's specific threshold on a periodic basis. Such periodically determined thresholds will more accurately reflect the aging or changing character of each of the detectors than will a fixed, unchangeable, common threshold.

SUMMARY OF THE INVENTION

An apparatus is provided for determining an alarm threshold of a detector which has an internal, variable, characteristic parameter which corresponds to an external value transmitted from the detector which to be sensed remotely. The detector also has a test condition which produces an external test value which can be sensed remotely.

The apparatus includes circuitry for sensing a value from the detector corresponding to a first condition, such as a clear air condition, at the detector and corresponding to a first internal parameter value. The apparatus also includes circuitry for sensing a value from the detector corresponding to the detector test condition.

Circuitry in the apparatus determines a selected incremental change of the internal parameter value from the parameter value which corresponds to the first, clear air condition. The apparatus also includes circuitry for converting the internal parameter incremental change value to a detector specific incremental value. Finally, the apparatus includes circuitry for combining the detector specific incremental value with the value returned from the detector corresponding to the first, clear air, condition thereby forming an alarm threshold.

The apparatus can include circuitry for storing the value corresponding to the alarm condition. Circuitry is also provided for storing the various values sensed from each selected detector.

The apparatus further includes circuitry for sensing a subsequent value returned from the detector corresponding to a then current ambient condition. This subsequently returned value is compared to the stored, previously determined, alarm threshold for that detector. In the event that the subsequently detected value exceeds the predetermined alarm threshold for that detector, an alarm indication can be generated.

The apparatus can include a transmission system for coupling each of the detectors, bidirectionally, to a control unit whereat the alarm threshold is determined and stored. The transmission system can transmit information bidirectionally between the control unit and each of the detectors using, for example, a pulse width modulation scheme.

Utilizing such a pulse width modulation scheme, values return from the detector correspond to a pulse width in milliseconds or microseconds. Information can be sent from the control unit to each of the detectors in digital form by means of the bidirectional transmission line.

A method of establishing an alarm threshold for each member of a group of detector units which is coupled via a common communication line to a central control unit includes the step of storing a value, common to each of the detectors This value is indicative of an expected incremental variation in a detector parameter between the clear air condition and an alarm condition.

A detector is then selected. A value returned from the selected detector, indicative of a clear air condition at the detector, is sensed and stored. A value returned from the selected detector, indicative of a test condition at the detector, can be sensed and stored.

The value indicative of the clear air condition from the detector and the common incremental value are combined to produce an alarm threshold for the selected detector. The alarm threshold is then stored.

An alarm threshold for each additional detector in the system can be determined using the above steps. Each such determined alarm threshold can then be stored.

To determine whether or not an alarm condition is present, a detector having a previously stored alarm threshold is selected. A current value returned from the selected detector, indicative of an ambient condition at the detector, is sensed.

The value currently returned from the selected detector is compared to the predetermined alarm threshold for that detector. In the event that the current value returned from the detector exceeds the alarm threshold value, an alarm condition can be initiated.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE PREFERRED EMBODIMENTS

Figure 1:
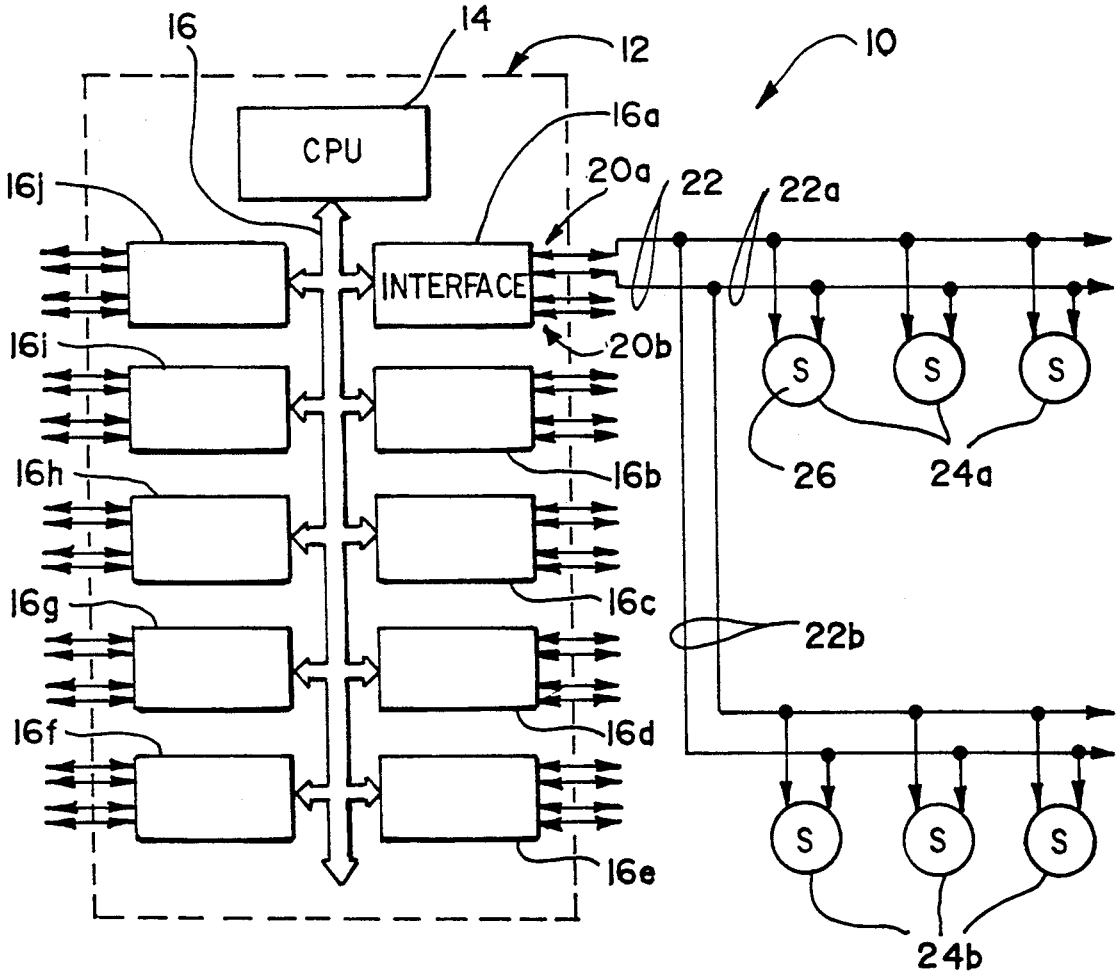
FIG. 1 is an overall block diagram illustrating a detection system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 of the type useable with the present invention. The system 10 includes a control unit 12 which would be located in the vicinity of a central control panel.

The control unit 12 includes a programmable central processing unit 14. The processing unit 14 can be a commercially available microcomputer.

The processing unit 14 is coupled via a bidirectional data and address bus 16 to a plurality of communications line interfaces **16*a* through 16*j*. Each of the interfaces, such as the interface 16*a* includes dual input/output ports, such as the ports 20*a* and 20*b***.

Each of the input ports, such as input/output port **20*a* can be coupled to a bidirectional communications line 22. The line 22 can be split into two segments, for example, 22*a* and 22*b***.

Coupled to each of the segments **22*a* and 22*b* is a plurality of detectors or sensors 24*a* and 24*b* respectively. Each of the detectors or sensors, such as the detector 26, can be a combustion products detector such as an ionization-type or a photoelectric-type smoke detector. It will be understood that other types of detectors or sensors could be used with the system 10** without departing from the spirit or scope of the present invention.

The detector 26 can receive commands from the control unit 12 via the bidirectional lines 22. Similarly, the detector 26 can return information indicative of a detected ambient condition such as smoke level or temperature.

Figure 2:
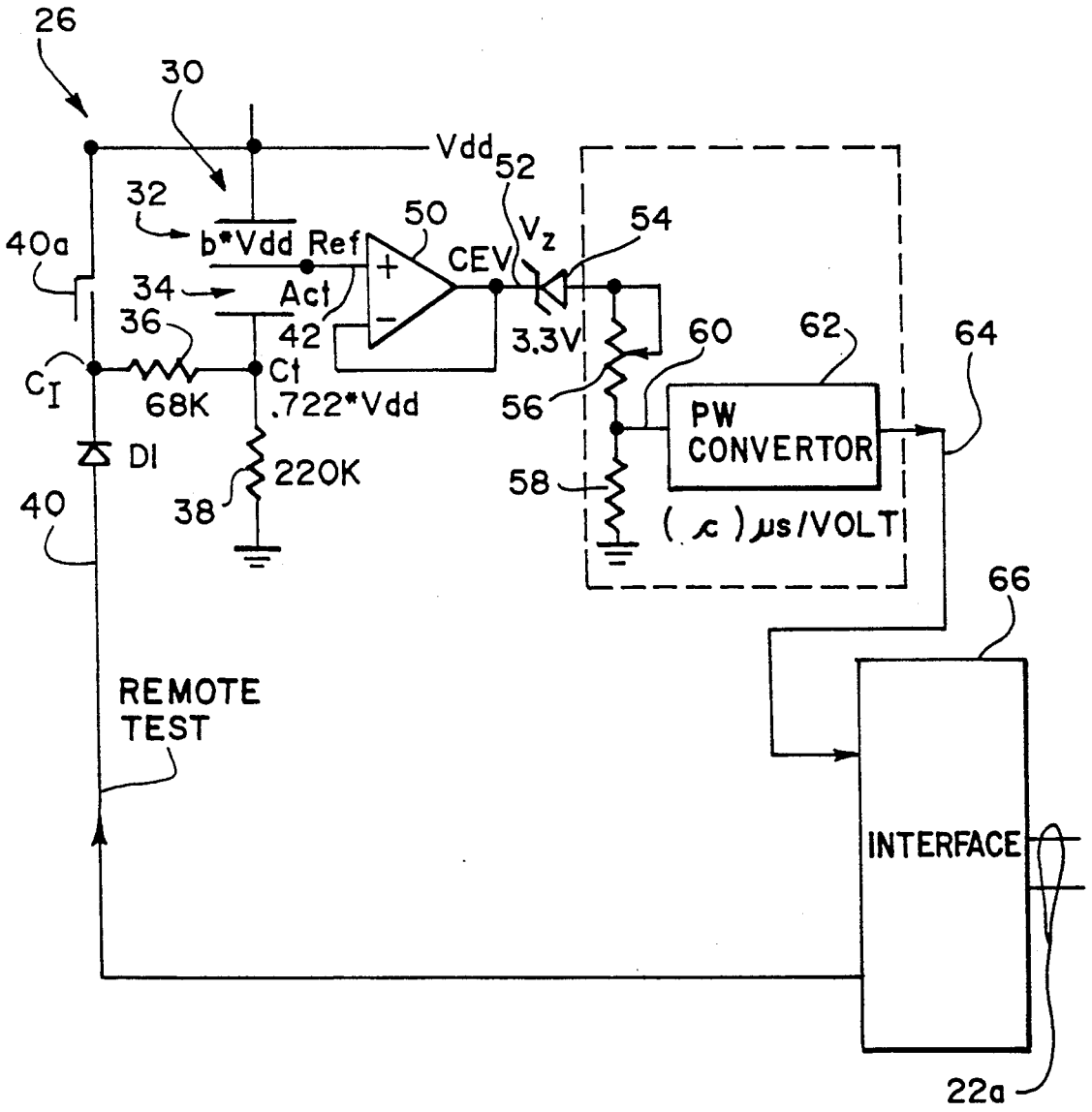
FIG. 2 is a schematic illustrating a portion of one of the detectors or sensors of the system of FIG. 1.

FIG. 2 is a portion of a schematic of an ion-type detector, such as the detector 26, usable in the system 10. The detector 26 includes a two-part chamber 30. The chamber 30 includes a reference chamber 32 and an active chamber 34.

Chamber 32 is coupled to a source, $V_{dd}$. Chamber 34 is connected to a node $C_T$.

The node $C_T$ is in a voltage divider formed of resistors 36, 38. A second node $C_I$ is between resistor 36 and a remote test input 40. A positive going signal on the line 40, initiated by a "test" command from the central panel 12 causes the detector 26 to go into a test condition.

In a normal clear air state essentially zero current flows through the chamber 30. The voltage at node $C_T$ is essentially zero as the impedance across the chamber 30 is very high—hundreds of meg. ohms.

As is conventional in ion chambers, a center electrode 42 provides a variable voltage output, CEV in response to conditions in the active chamber 34. In clear air, the output voltage CEV is essentially equal to $b*V_{dd}$. The constant b is set by the physical chamber characteristics.

When a test is initiated, via the remote test input 40 or local test switch **40*a***, a voltage $V_{dd}$ is applied to node $C_I$. A test voltage of $220/(220+68)*(V_{dd}-0.6)$ is applied to node $C_T$ and equals 0.722 $V_{dd}$ for the illustrated resistor values.

In response to the applied test voltage, the output voltage from electrode 42 increases to:

$$\begin{aligned} CE_{TEST} &= b(V_{dd} - C_T) + C_T \\ &= b(V_{dd} - .722\ V_{dd}) + .722\ V_{dd} \end{aligned}$$

The output test voltage from electrode 42 is dependent on $V_{dd}$, b, and the ratio of resistors 36, 38. The values of resistors 36, 38 have been chosen as representative of the output from chamber 30 in response to the presence of some nominal degree of smoke. However, no particular ratio is required.

Different resistance ratios could be used, since no specific smoke condition is required. The disclosed values, 68K Ω for resistor 36, and 220K Ω for resistor 38, preferably will be the same for all ion detectors in the pluralities **24*a*, 24*b***.

The output from the electrode 42 is buffered in a unity gain, non-inverting operational amplifier 50. Output from the amplifier 50, on a line 52 is at a substantially lower impedance than the output impedance of the chamber 30.

The output voltage on line 52 is applied via a reverse biased Zener diode 54 to a voltage divider formed of potentiometer 56 and fixed resistor 58. A divided analog output voltage level on a line 60 has an amplitude corresponding to the condition of the chamber 10.

The analog voltage on the line 60 is converted in a voltage-to-pulse converter 62 to a corresponding pulse width on a line 64. The detector output, on the line 64 is a sequence of pulse widths. The pulse width on the line 64 is related to input voltage on the line 60 by a constant c μsec/volt.

The output on the line 64 can be coupled by interface circuitry 66 to the bidirectional communication lines 22*a*. The control unit 12 can then sense the value on the lines 22 from the detector 26 indicative of the ambient condition thereat.

The clear air output voltage on the line 42 of detector 26 can be expressed as a pulse width by:

$$CA = c(CEV - V_z) = c(b*V_{dd} - V_z).$$

The output voltage on the line 42 when the detector 26 is in the test mode can be expressed as a pulse width by:

$$T = c*(0.722\ V_{dd} + 0.278*b*V_{dd} - V_z).$$

Figure 3:
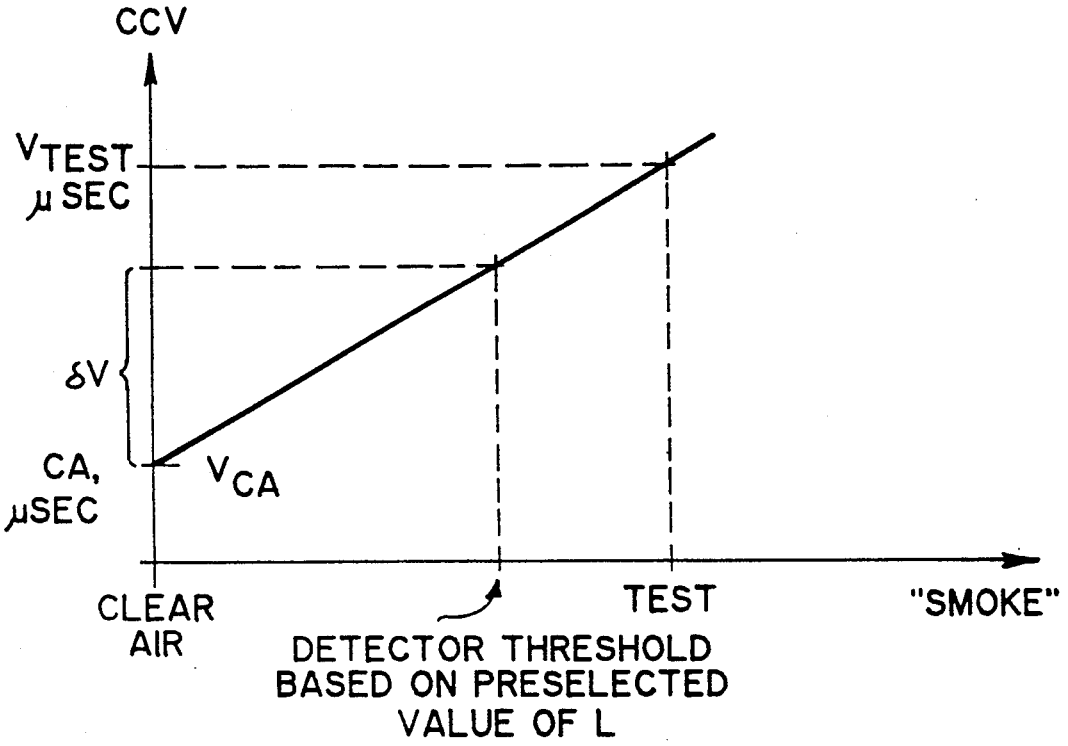
FIG. 3 is a linearized plot of output voltage versus level of smoke for the detector of FIG. 2.

FIG. 3 illustrates a linearized plot of chamber output voltage, $V_{OUT}$, as measured at the output, line 42, of the detector of FIG. 2 vs. "Smoke." Detectors of the type in FIG. 2 will normally operate in a range between the clear air point, CA, and the test point, TEST, of FIG. 3.

The clear air output pulse width can be measured at the control unit 12. This corresponds to a particular pulse width that is stored for the respective detector by the processor unit 14.

The test value output pulse width of the detector 26 is then contemporaneously measured. This value is also stored by the processor unit 14.

The slope of the line between the clear air output pulse width CA and the test output pulse width T can be derived from the equations for the detector. That slope is the same as the constant "c" and is equal to:

$$c = \frac{(T - .278*CA)}{(.722)*(V_{dd} - V_z)}\ \mu\text{sec/volt}$$

where $V_{dd} = 10.5$ volts and $V_z = 3.3$ volt.

By measuring the clear air output, CA, in μsec and the test condition output, T, in μsec, at essentially the same time, the slope c of a line joining those two points can be obtained using the above equation. Then, the incremental output voltage change δV for an intermediate smoke condition, "x" such as measured during normal operation can be determined at the panel:

$$c*(\delta V)\mu sec = x - CA$$

where $x = c*(\delta V) + CA$ μsec.

Thus, without any knowledge as to the level of smoke density in the chamber that the test condition corresponds to, if the value of "x" μsec can be calculated for a particular δV in the chamber, then "x" can be set as an alarm threshold particular to that detector if related somehow to a level of smoke in the chamber.

The above described method or process can be combined with a physical constant of the chamber common to all detectors of the pluralities 24*a*, 24*b*. The constant is based on a graph of output voltage, $V_{OUT}$, vs. current I of the chamber 30 in a standardized smoke box for various smoke conditions as plotted in FIG. 4. The graph of FIG. 4 is measured off of a detector, such as the detector 26 of FIG. 2 located in a smoke box.

Figure 4:
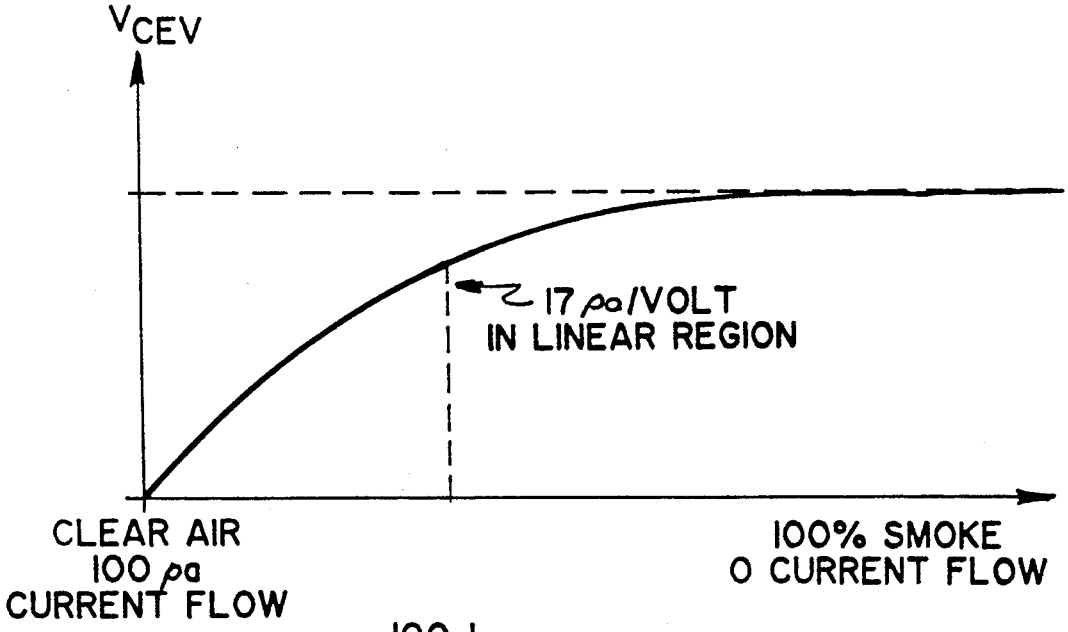
FIG. 4 is a standardized plot illustrating output voltage versus smoke or current flow for a detector useable with the system of FIG. 1.

Detector output voltage, is plotted in FIG. 4 as a function of smoke density in the box. The smoke density is indicated by the current flowing in an indicating chamber in the box. The current flow varies from 100 pa in clear air, to zero current at 100% smoke.

In a clear air condition, corresponding to 100 pA in the chamber for the smoke box, the detector 26 has a voltage output of approximately half the internal power supply voltage. As the smoke is increased in the smoke box, the smoke box chamber current decreases and gives a measurement of the level of smoke in pico amps. At the same time, the voltage in the chamber of the detector 26 when tested in the box is increasing with the level of smoke.

In the linear region, the output voltage of the detector 26, Vcev, is related to the smoke box chamber current by a constant, 17 pA/volt. The slope in the linear region is 1/17 volt/pA.

The desired position L on the graph in pico amps can be related to a corresponding change in chamber output voltage by:

$$\delta V = \frac{100 - L}{17}$$

where L is a value of smoke box chamber current corresponding to an alarm level of smoke. This can be a constant for all detectors in the pluralities 24*a*, 24*b*. Alternately, a different L threshold value could be selected for different detectors. The voltage variation and output pulse width variation are related by:

$$(\delta V)*\ c\mu sec/volts = \mu sec$$

where δμsec corresponds to a change in output pulse width from that of clear air, needed to achieve a desired alarm level or threshold as determined by L (in pico amps).

The above relationships depend on the previously noted constant of 17 pa/volt which is a common, storable characteristic of the detectors in the pluralities 24*a*, 24*b*. Once the variation, for a given L threshold value, is known then the alarm level AL in microseconds can be determined by:

$$AL = CA + \delta\mu sec.$$

A pulse width from the detector 26 that equals or exceeds AL is an alarm condition. Thus, in the control unit 12 it is only necessary to compare a returned pulse width to the calculated and prestored alarm threshold AL.

The value of c for a given value of clear air (CA) and test (T) in microseconds as noted previously, can be determined from:

$$c = \frac{(T - .278*CA)}{.722*(V_{dd} - V_z)}$$

The test output value can vary over time with respect to a given unit. So can the clear air value. However, by remeasuring both from time to time, the alarm level can be regularly recalculated if desired.

As an example, for a measured detector, $$CA = 438\ \mu\text{sec}$$
$$T = 1{,}474\ \mu\text{sec}$$

$$c = \frac{(T - .278*CA)}{(.722)*(V_{dd} - V_Z)} = 260\ \mu\text{sec/volt}$$

assuming that the desired threshold L level should equal 57.5 pa. Then:

$$\delta V = \frac{100 - 57.5\ pa}{17\ pa/\text{volt}} = 2.5 \text{ volts}$$

This is the variation, δV, from clear air, for the selected current threshold, L, for all ion-type detectors, members of the pluralities 24*a*, 24*b*. This value can be calculated once and stored. Then, $$\delta\mu\text{sec} = c*\delta V = 260*2.5 = 650\ \mu\text{sec}$$

As a result, the calculated alarm threshold AL for this particular detector should be set at:

$$AL = CA + \delta\mu\text{sec} = 438\ \mu\text{sec} + 650\ \mu\text{sec.}$$

Once the calculated alarm level AL is known, that value is stored at the control unit 12. The pulse widths of data returned from a selected detector need only be compared to the prestored respective value of AL to determine if the detector is indicating an alarm condition.

Non-linearties can be minimized using an empirically derived correction factor applied to each calculated value of AL. This factor, f, is determined from:

$$f = abs.\ value\ of\ [0.1*(AL - \{(\delta V - 2.5\}*c + 2{,}000))]$$

$$AL_{CORRECTED} = AL - f$$

Given a previously calculated and stored alarm threshold, AL, the current detector location (current sensitivity) on the curve of FIG. 4 can be estimated by the following equation:

$$L = 100 - \frac{17}{c}*[AL - CA_c]\ p\ \text{amp}$$

In the above equation, $CA_c$ represents a current value of clear air read back from the subject detector such as the detector 26. c is determined based on the current test value Tc. The calculated L value can be displayed at the control unit 14 for an operator to see. Alternately, the L value, the sensitivity of the detector, can be used to determine when to initiate a recalculation of the AL threshold.

Alternately, the sensitivity could be displayed at other locations. For example, sensitivity, as well as other information, could be displayed at a remote terminal.

Figure 5:
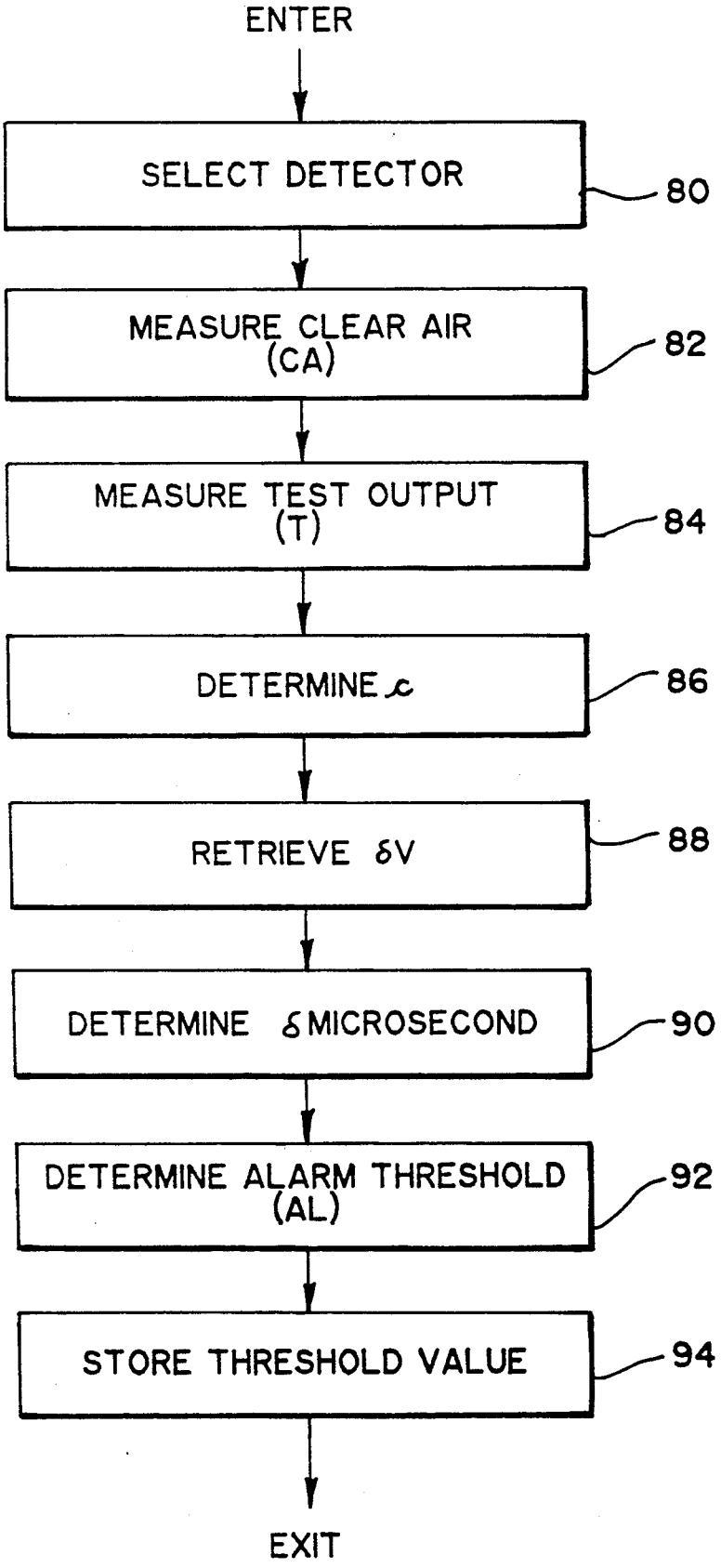
FIG. 5 is a flow diagram illustrating a threshold determination in accordance with the present invention.

FIG. 5 illustrates a flow diagram of the method of determining an alarm level or threshold for the detector 26. In a step 80, the process is initiated by selecting a detector. The clear air return value from the selected detector is sensed at the control unit 12 in a step 82. The control unit 12 then commands the selected detector to enter its test mode. The returned test value from the selected detector is sensed at the control unit 12 and stored in a step 84.

In a step 86, the control unit determines a value for c based on the previously measured and stored values for clear air and the test condition in a step 86. In a step 88, the control unit retrieves a common prestored parameter variation value δV. This corresponds to the expected variation of the chamber output voltage from clear air in response to the presence of a predetermined smoke level.

Using the value of δV retrieved in the step 88, the value of δμsec is determined in a step 90. Subsequently, in a step 92 the value of the alarm level or threshold AL can then be determined. The determined alarm level or threshold is stored in a step 94 at the control unit 12 for subsequent use. Using the above-described process, a threshold or alarm level can be determined uniquely for each detector in the pluralities 24*a* and 24*b*.

Subsequently, to determine whether or not a selected detector, such as the detector 26, is exhibiting an alarm condition, the current ambient condition being sensed at the detector, a representation of which is then transmitted to the control unit 12, is compared to the predetermined alarm level or threshold. If the current ambient representation exceeds the predetermined alarm threshold the control unit 12 can place the system into alarm.

The above-described comparison process can be repeated and the results averaged out over several trials to minimize false alarms. Further, if desired, the alarm level can be redetermined on a regular or intermittent basis depending on the environmental circumstances of the alarm system 10.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

We claim:

1. An apparatus for determining an alarm threshold of a detector having an internal, variable, characteristic parameter which corresponds to an external detector value, the detector also having a test condition, the apparatus comprising:

means for sensing a value from the detector corresponding to a first condition at the detector and a first internal parameter value and for sensing a value from the detector corresponding to the detector test condition;

means for determining a selected, incremental change of the internal parameter value from the parameter value corresponding to the first condition;

means for converting said internal parameter incremental change to a detector specific incremental value; and means for combining said detector specific incremental value with said value corresponding to said first condition thereby forming the alarm threshold.

2. An apparatus as in claim 1 with said combining means including an adder.

3. An apparatus as in claim 1 including means for storing said sensed values.

4. An apparatus as in claim 3 wherein said storing means includes storage for said selected, incremental change of the internal parameter value.

5. An apparatus as in claim 1 which includes means for storing said determined alarm threshold.

6. An apparatus as in claim 5 which includes means for sensing a subsequent value from the detector, corresponding to a second condition, and means for comparing said subsequent value to said stored, determined alarm threshold.

7. An apparatus as in claim 6 which includes means for generating an alarm indication in response to said subsequent value exceeding said stored, predetermined alarm threshold.

8. An apparatus as in claim 1 wherein said sensing means includes pulse width detection circuitry.

9. An apparatus as in claim 1 wherein the internal detector parameter corresponds to a voltage and with said selected incremental change in the parameter corresponding to an incremental voltage value change with said converting means including circuitry for converting said incremental voltage change to a representation combinable with said value corresponding to said first condition.

10. An apparatus usable in a distributed detector system for establishing an alarm threshold for at least some of the detectors while the respective detectors are in clear air comprising:

a control unit;

means, coupled between the detectors and said control unit, for communicating bidirectionally;

means for causing a selected detector to return a clear air output value, via said communicating means, to said control unit;

means, carried by said control unit, for placing the selected detector into a test condition and for causing the detector to return a test output value, via said communicating means to said control unit;

means, carried by said control unit for storing said clear air output value and said test output value; and means for combining at least said clear air output value with a predetermined incremental value to form a detector specific alarm threshold.

11. An apparatus as in claim 10 wherein said combining means includes means for storing an incremental variation parameter common to at least some of the detectors.

12. An apparatus as in claim 10 including means for sensing a value from a selected one of the detectors; and means, coupled to said value sensing means, for comparing said sensed value to a said corresponding alarm threshold.

13. An apparatus as in claim 12 including means, coupled to said comparing means, for generating a discernable alarm in response to said sensed value exceeding said corresponding alarm threshold.

14. An apparatus as in claim 10 wherein said combining means includes circuitry for combining said test value with said clear air output value.

15. An apparatus as in claim 10 wherein said communicating means includes pulse width detecting circuitry.

16. An apparatus as in claim 10 including means for determining a sensitivity parameter for a selected detector.

17. An apparatus as in claim 16, including means for displaying a determined sensitivity parameter for selected of said detectors.

18. A method of establishing an alarm threshold for each member of a group of detector units coupled to a common communication line comprising the steps of:

(a) storing a value, common to each of the detectors, indicative of an expected incremental variation in a detector parameter between a clear air condition and an alarm condition;

(b) selecting a detector;

(c) sensing and storing a value returned from the selected detector indicative of a clear air condition at the detector;

(d) sensing and storing a value returned from the selected detector indicative of a test condition at the detector;

(e) combining at least the value indicative of clear air and the common incremental value to produce an alarm threshold for the selected detector;

(f) storing the alarm threshold; and selecting another detector and repeating steps (c) through (f).

19. A method as in claim 18 including:

selecting a detector with a previously stored alarm threshold;

sensing a value returned from the selected detector indicative of a current ambient condition;

comparing the value, indicative of the current ambient condition, to the alarm threshold; and generating an alarm in response to the results of the comparing step.

20. A method as in claim 18 including selecting a detector and determining a sensitivity parameter for the selected detector.

21. A method as in claim 20 including displaying the determined sensitivity parameter.

22. A multiple detector fire alarm system comprising:

a plurality of detectors with each member of said plurality having an input/output communication port, circuitry for detecting an ambient condition and circuitry for generating a value at the port indicative of the ambient condition;

a control unit displaced from said detectors;

means for coupling said control unit to a said respective port of each member of said plurality;

said control unit including means for storing an incremental parameter common to the members of said plurality;

means for sensing a value from each said detector corresponding to a respective ambient condition; and means for establishing an alarm threshold for each said detector responsive to a respective one of said detector ambient condition values and said stored common incremental parameter.

23. A system as in claim 22 including means, carried by said control unit, for storing each said established threshold.

24. A system as in claim 23 wherein said control unit includes means, coupled to said storing means, for comparing a said established alarm threshold for a selected detector to a subsequent, sensed, ambient condition value from said selected detector.

25. A system as in claim 24 including means, at said control unit, responsive to said comparing means for generating an alarm indicium.

26. A system as in claim 22 including circuitry for establishing a sensitivity value for selected of said detectors.

27. A system as in claim 26 including means for displaying one or more of said sensitivity values.

* * * * *

UNITED STATES PATENT AND TRADEMARK OFFICE

CERTIFICATE OF CORRECTION

PATENT NO. : 5,172,096

DATED : December 15, 1992

INVENTOR(S) : Tice et al.

It is certified that error appears in the above-identified patent and that said Letters Patent is hereby corrected as shown below:

Column 6, line 38, please change "= μsec" to --= δ μsec--.

Signed and Sealed this

Second Day of November, 1993

Attest:

Bruce Lehman

BRUCE LEHMAN

Attesting Officer

Commissioner of Patents and Trademarks